US012059074B2

(12) United States Patent
Chapman

(10) Patent No.: US 12,059,074 B2
(45) Date of Patent: Aug. 13, 2024

(54) PORTABLE SALON STATION AND ACCESSORIES

(71) Applicant: Office Cuts, Inc., Alexandria, VA (US)

(72) Inventor: Tamara L. Chapman, Alexandria, VA (US)

(73) Assignee: Office Cuts, Inc., Alexandria, VA (US)

( * ) Notice: Subject to any disclaimer, the term of this patent is extended or adjusted under 35 U.S.C. 154(b) by 287 days.

(21) Appl. No.: 17/525,320

(22) Filed: Nov. 12, 2021

(65) Prior Publication Data

US 2023/0148755 A1 May 18, 2023

(51) Int. Cl.

| | |
|---|---|
| ***A47C 1/11*** | (2006.01) |
| ***A45C 5/14*** | (2006.01) |
| ***A45C 7/00*** | (2006.01) |
| ***A45C 13/00*** | (2006.01) |
| ***A45C 13/26*** | (2006.01) |
| ***A47C 4/52*** | (2006.01) |
| ***A47C 7/50*** | (2006.01) |

(52) U.S. Cl.

CPC ..... *A47C 1/11* (2013.01); *A45C 5/14* (2013.01); *A45C 13/262* (2013.01); *A47C 4/52* (2013.01); *A45C 7/0045* (2013.01); *A45C 7/0086* (2013.01)

(58) Field of Classification Search

CPC ..... A45C 5/14; A45C 7/0045; A45C 7/0086; A45C 13/262; A47C 1/11; A47C 4/52

USPC ..... 297/17, 35–47, 188.01–188.13, 423.4, 297/423.44, 423.19–423.3; 15/323; 190/109, 110

See application file for complete search history.

(56) References Cited

U.S. PATENT DOCUMENTS

| | | | | | |
|---|---|---|---|---|---|
| 1,482,819 | A * | 2/1924 | Simonson, II | A47K 1/02 | 312/226 |
| 1,802,890 | A * | 4/1931 | Fritsch | A45D 19/10 | 297/188.05 |
| 2,679,288 | A * | 5/1954 | Larger | A47C 1/11 | 312/236 |
| 2,696,873 | A * | 12/1954 | Mundt | A47C 1/06 | 297/188.05 |
| 3,044,828 | A * | 7/1962 | Fowler | A47C 1/08 | 297/188.06 |
| 3,235,305 | A * | 2/1966 | Dlouhy | A61G 15/10 | 297/188.05 |
| 3,245,716 | A * | 4/1966 | Danner | A47C 1/11 | 297/188.05 |
| 3,506,323 | A * | 4/1970 | Leprince | A61L 2/00 | 312/211 |
| 3,679,257 | A * | 7/1972 | Jacuzzi | A61G 5/1024 | 297/42 |
| 3,697,127 | A * | 10/1972 | Robertson | A47C 1/04 | 297/188.05 |
| 3,712,669 | A * | 1/1973 | Cates | A47C 1/06 | 297/188.21 |

(Continued)

*Primary Examiner* — Rodney B White

(74) *Attorney, Agent, or Firm* — WRB-IP PLLC

(57) ABSTRACT

A hairstylist's portable salon forms a work space for a hairstylist that may be taken with the hairstylist to any location where a client is available for service. The portable salon includes a portable case, an adjustable chair, and an accessory stand. Accessories including a chair with a hinged chair base, a variety of accessory trays and mirror attachments for attaching to the portable base and accessory stand, and a silicone pocket for insulating and holding heated tools are also provided.

14 Claims, 10 Drawing Sheets

(56) References Cited

U.S. PATENT DOCUMENTS 3,994,528 A * 11/1976 Humphrey ..... A47C 1/04 15/301
4,013,318 A * 3/1977 Piper ..... A63C 11/001 280/809
4,136,907 A * 1/1979 Hermanns ..... A47C 1/06 312/235.7
4,240,662 A * 12/1980 Anderson ..... A47C 1/10 297/182
4,258,964 A * 3/1981 Cowen, Jr. ..... A45D 44/02 D24/185
4,329,002 A * 5/1982 Cowen ..... A45D 44/02 132/73
4,372,605 A * 2/1983 Cervantes ..... A47C 1/11 297/188.21
4,995,670 A * 2/1991 Rodas ..... A47C 7/004 297/423.38
5,039,167 A * 8/1991 Sweet ..... A47C 1/04 297/423.37
5,062,557 A * 11/1991 Mahvi ..... A45F 4/02 190/110
5,205,013 A 4/1993 Lopes
5,230,450 A * 7/1993 Mahvi ..... A45C 9/00 190/110
5,359,461 A 10/1994 Rice et al.
5,489,140 A * 2/1996 Van Horn-Plato ..... A47C 1/04 297/182
5,505,524 A 4/1996 Drumwright
5,526,539 A * 6/1996 Bower ..... A45D 19/04 312/317.3
5,529,322 A * 6/1996 Barton ..... A45C 5/14 280/30
5,533,799 A 7/1996 Nickolaus, Jr.
5,547,393 A 8/1996 Jansen
5,899,467 A * 5/1999 Henkel ..... B62B 1/002 190/1 X
5,946,768 A 9/1999 Kelly
5,950,826 A * 9/1999 Lykowski ..... A45D 1/00 190/102 X
5,967,632 A * 10/1999 Lamia ..... A45D 44/02 312/249.8
6,095,156 A * 8/2000 Smith ..... A45D 44/02 132/286
6,105,508 A * 8/2000 Ryburg ..... A47B 23/02 108/42
6,296,310 B1 * 10/2001 Laudenslayer ..... A47C 1/06 297/344.19
6,390,345 B1 * 5/2002 Brown ..... A45C 3/00 190/110
6,439,134 B1 * 8/2002 Ryburg ..... A47B 23/04 108/42
6,533,360 B1 * 3/2003 Parkel ..... A47C 7/506 297/423.28
6,659,339 B2 * 12/2003 Konishi ..... G07F 17/0014 235/375
6,733,081 B1 * 5/2004 Follon ..... A47C 1/04 297/423.26
6,736,073 B2 * 5/2004 Ryburg ..... A47B 23/04 108/42
7,261,384 B1 * 8/2007 Craft, Jr. ..... A47B 46/00 312/224
7,445,291 B2 * 11/2008 Parkel ..... A47C 7/50 297/423.26
7,472,455 B2 1/2009 Dolton
7,496,986 B2 * 3/2009 Jones ..... A46B 7/023 15/246
8,317,205 B2 * 11/2012 Udall ..... B62B 5/049 280/47.25
8,534,762 B2 * 9/2013 Linhoff ..... A47C 1/06 297/423.37
8,544,943 B2 * 10/2013 Fields ..... A47C 1/11 297/195.11
D734,030 S * 7/2015 Wang ..... D3/274
9,277,796 B1 * 3/2016 Elam ..... A45C 9/00
9,554,643 B2 * 1/2017 Nelson ..... A47B 5/02
9,918,546 B2 * 3/2018 Smith ..... A45C 5/06
10,213,021 B2 * 2/2019 Walters ..... A47C 1/06
10,285,495 B1 * 5/2019 Valme ..... A47B 13/081
10,561,234 B1 * 2/2020 von Goins ..... A47B 23/06
11,140,958 B1 * 10/2021 Baldwin ..... A45C 13/28
11,457,727 B1 * 10/2022 Weber ..... A47B 3/10
11,627,787 B2 * 4/2023 Bladd-Symms ..... A44B 11/065 190/107
11,717,066 B1 * 8/2023 Navarro ..... A45C 13/262 190/11
11,780,075 B2 * 10/2023 Barton ..... A45C 13/02 206/372
2002/0084731 A1 * 7/2002 Konishi ..... A45D 44/02 312/235.5
2005/0122009 A1 * 6/2005 Konishi ..... E04H 1/125 312/209
2005/0224305 A1 * 10/2005 Davis ..... A45C 5/14 190/110
2006/0123712 A1 6/2006 Nolting
2007/0241649 A1 * 10/2007 Thomas Carter ..... A47B 67/04 312/290
2010/0236884 A1 * 9/2010 Brown ..... A45C 9/00 190/11
2011/0133527 A1 * 6/2011 Taylor ..... A47C 7/5066 297/423.37
2012/0025681 A1 * 2/2012 Ton ..... A47B 46/00 312/309
2012/0242204 A1 * 9/2012 Boyer ..... A47B 67/005 312/226
2013/0032443 A1 * 2/2013 Soedomo ..... A45C 9/00 190/11
2013/0087424 A1 * 4/2013 Pratt ..... A45C 13/04 190/107 X
2013/0099648 A1 * 4/2013 Moore ..... A47B 3/10 190/11
2014/0166414 A1 * 6/2014 Moore ..... A45C 5/065 190/8
2014/0238799 A1 * 8/2014 Sharma ..... B62B 1/125 108/18
2015/0027836 A1 * 1/2015 Zhou ..... A45C 5/14 190/12 A
2016/0022032 A1 * 1/2016 Simon ..... A45C 13/28 108/42
2016/0037905 A1 * 2/2016 Glover ..... A47B 3/12 108/42
2017/0325560 A1 * 11/2017 Williams ..... A47B 5/04
2021/0274928 A1 * 9/2021 Hanks ..... A47B 23/041
2023/0091868 A1 * 3/2023 Schmidt ..... A45D 44/14 297/188.04
2023/0137062 A1 * 5/2023 McGuire ..... A45D 44/02 312/209
2024/0081522 A1 * 3/2024 Byrne ..... A45C 13/28

* cited by examiner

PORTABLE SALON STATION AND ACCESSORIES

BACKGROUND OF THE INVENTION

1. Field of the Invention

The present invention relates to a salon station and, more particularly, to a convertible wheeled case with height adjustable chair and accessories that convert into a portable salon station.

2. Discussion of the Related Art

The typical business model for modern stylist involves a salon in a building, commonly known as a "brick and mortar" or traditional salon. This type of salon involves substantial expense for the building, facilities, equipment, and other items necessary to carry out the day-to-day business. These expenses are paid by the stylists who work at the salon from the fees charged to customers; thus, reducing the stylists' income for simply having access to a work station.

With travel and social distancing limitations imposed on society within the past few years it has become increasingly difficult to find access to brick and mortar salons as they are limited by the number of people allowed to be present. In addition to these limitations there is also the issue of being in a confined space with a number of people that may or may not have the same or similar safety concerns as the customer.

Additionally, customers can find it difficult to schedule an appointment during regular business hours as the customers are also typically employed and working at that time. Customers can also find it difficult to schedule appointments in off-hours and weekends as they are competing with others with similar schedules with limited time to go to a salon. Further, the stylists need to accommodate the clients' schedules or have limited income; thus, the hairstylist must make a choice between scheduling time outside of normal work hour to accommodate clients or have personal time away from work.

It is common for some stylists to travel to their customers' homes, workplaces, and a variety of other locations to provide services to individuals or groups of individuals. It is also a goal to provide professional styling services with ease and grace to the home-bound, immobile and others with the inability to go to a traditional salon or barber shop. As the aged population increases there will also be an increasing need for services for those "aging in place."

Traveling to non-salon locations typically involves the stylist having to improvise a makeshift styling tote or station with a subset of equipment and subject to the facilities are available (e.g., appropriate height salon chair, mirrors, shelves, table for tools, running water, wash basin, vacuum, etc. . . . ) wherever the work is to be performed. Facilities may be an individual's home, an office space, conference room, or even outdoors. Attempts to create a salon-like atmosphere are still lacking as some of the essential tools, such as an adjustable chair, stationary mirrors, or workspace are typically not easily portable. Carting the amount of items needed to provide typical services can create significant disadvantages, including fatigue and lack of convenience from carting a work cart or bag not intended for expanding into a stylist's workspace. These carts or bags also provide limited space and may limit the variety of items available for use and may even limit the functionality of items compared to similar equipment in a traditional salon as smaller items are typically used to minimize weight and space.

Quality work is also more difficult when a stylist arrives with limited equipment and uses the client's chair and table to create their workspace. The client's chair is unlikely to be adjustable or have a foot rest, either or both help position the client properly for hair cutting, coloring, and styling. Not having a proper chair that allows for the client to be adjusted to the proper height for the stylist can create back pain for the stylist. Having the client at eye level is a preferred arrangement but difficult to achieve with typical chairs and benches available at home, offices, and other locations.

Using a client's chair and table as part of the workspace can also be problematic as it impacts the integrity of the client's home or office with the possibility of leaving debris, oil, or chemical spills on the client's furniture. Further, the client's table or other space is likely to be occupied with the client's belongings providing for limited available space for the stylist's materials.

It is desirable to provide greater flexibility in terms of working hours, locations, safety protocols, and breadth of capabilities for stylists. It is also desirable to provide an organized arrangement to facilitate hairstylists to perform styling operations in virtually any location at any time in a manner that is similar to being in a traditional salon. It is also desirable to provide a portable case that is light weight and easily moveable that can be expanded into a workstation that provides the same features as a typical salon with the functionality of the very heavy, non-portable chairs, mirrors, service carts, and other equipment typically found in a salon.

SUMMARY OF THE INVENTION

Accordingly, the present invention is directed to a portable hairstylist's station with improved accessories for use in a wide range of locations The intention of the stylist's salon is to provide a portable case for ease of transport of a stylist's tools and accessories that are easily adapted with the portable case for creating a transportable combination that expands into a work station similar to that in a traditional salon, including a salon chair, accessories stand, mirrors, and a service cart.

The stylist's station of the present invention includes a portable case, a salon chair, and accessories stand. In one embodiment, the chair includes a chair seat and a chair base. The chair seat is adaptable with the portable case in that it may be fit over the portable case. The chair base is a collapsible stand and interconnects with the chair seat to form the salon chair. When stored, the chair base is collapsed and contained within the portable case. The chair base provides the ability to adjust the height of the salon chair to suit the customer, as well as place the customer at the appropriate height for the stylist; thus, providing the best position to provide a professional haircut and styling, as well as limiting back pain and stress for the stylist.

According to a further embodiment, the chair seat includes a hinged section that allows the back of the chair seat to fold in half. A further embodiment allows the chair seat to recline. These adjustments allow for the customer to sit in a comfortable position at a comfortable height for the stylist to easily work. In further embodiments of the present invention, the hinge of the chair seat allows a customer to lean back to allow for manipulation of longer hair or provide ease of access to a washbasin for washing a customer's hair. In further embodiments, the chair seat further includes padding to provide additional comfort to the customer. In yet another embodiment, a foot rest may be incorporated in or attached to the chair base to provide a foot rest for the customer. With a client comfortably situated and stationary, the stylist may work around the client utilizing mirrors in front and back for a professional styling as if in a salon.

In another embodiment, the salon chair includes an attachable foot rest that is stored in the portable case when not in use. In a further embodiment, the foot rest is telescopic and may be collapsed for storage.

In a further embodiment, the stylist's station further includes a mirror that is carried in the portable case when in transport and that is adaptively attached to a telescoping handle on the portable case. The mirror may be attached with a compression fit, hook and loop fasteners, a magnetic connection, or other fixture that allows for the mirror to be connected and disconnected as needed by the stylist.

In another embodiment, the stylist's station includes an accessories stand for holding accessories in front of the client. In one embodiment the accessories stand holds a mirror that may be attached with a compression fit, hook and loop fasteners, a magnetic connection, or other fixture that allows for the mirror to be connected and disconnected as needed by the stylist.

The stylist's station further includes one or more trays that are carried in the portable case when in transport and that are adaptively attached to the telescoping handle on the portable case when in use. Each tray provides the stylist with a location to place tools or other items within easy reach while attending to a customer. Each tray may be attached with a compression fit, hook and loop fasteners, a magnetic connection, or other fixture that allows for the tray to be connected and disconnected as needed by the stylist.

In one embodiment, a tray provides a service basket with an indent or groove to fit on the handle of the portable case. This particular tray is deeper than other trays to be able to hold color bowls and materials for color treatments. In a further embodiment, the deep tray may also be inverted and used as a booster seat.

Further embodiments of the present invention provide access panels on the portable case allowing for access to the interior of the portable case from a variety of locations. In one embodiment, the portable case includes side panels that may be opened to allow easy access from the top to the bottom of the portable case providing the ability to access single items anywhere in the case without emptying the case or laying the case on its back or side to retrieve tools and equipment at any location within the case.

Further embodiments of the present invention provide heat protected pockets on the portable case to allow for protected placement of heated tools, such as flat irons and curling irons while the tools are too hot to place on other surfaces.

It is therefore an object of the present invention to provide a portable stylists' station with a portable case and a foldable chair that includes a backrest that adjusts forward or backward for optimal positioning and comfort of the user. The chair also interconnects with an adjustable base that allows for height adjustment. In a further embodiment, a footrest also interconnects with the chair. With the adjustable base and footrest removed, the chair is adaptable to firmly interconnect with the portable case for ease of transport.

It is also an object of the present invention to provide a portable stylists' station comprising a portable case with an extendable handle and a mirror that connects to the extendable handle while the stylists' station is in use.

It is a further object of the present invention to provide a portable stylists' station comprising a portable case with an extendable handle and one or more trays that temporarily connect to the handle while the stylists' station is in use.

It is yet a further object of the present invention to provide a portable stylists' station comprising a portable case with openings that provide access throughout the portable case without the need to empty the case or lay the case down to move items in and out of the case.

It is still further object of the present invention to provide a portable stylists' station with a portable case with heat resistant pockets for holding heated objects with the objects are at high temperatures.

It is another object of the present invention to provide additional pockets for placement of sanitary items, such as sani-neck strips, hand sanitizer, and first aid items. It will be appreciated that many additional pockets can be customized for materials and tools for services provided by the stylist.

These and other features and advantages will be set forth in the description that follows, and in part will be apparent from the description, or may be learned by practice of the invention. The objectives and other advantages of the present invention will be realized and attained by the structure particularly pointed out in the written description and claims hereof, as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Figure 1:
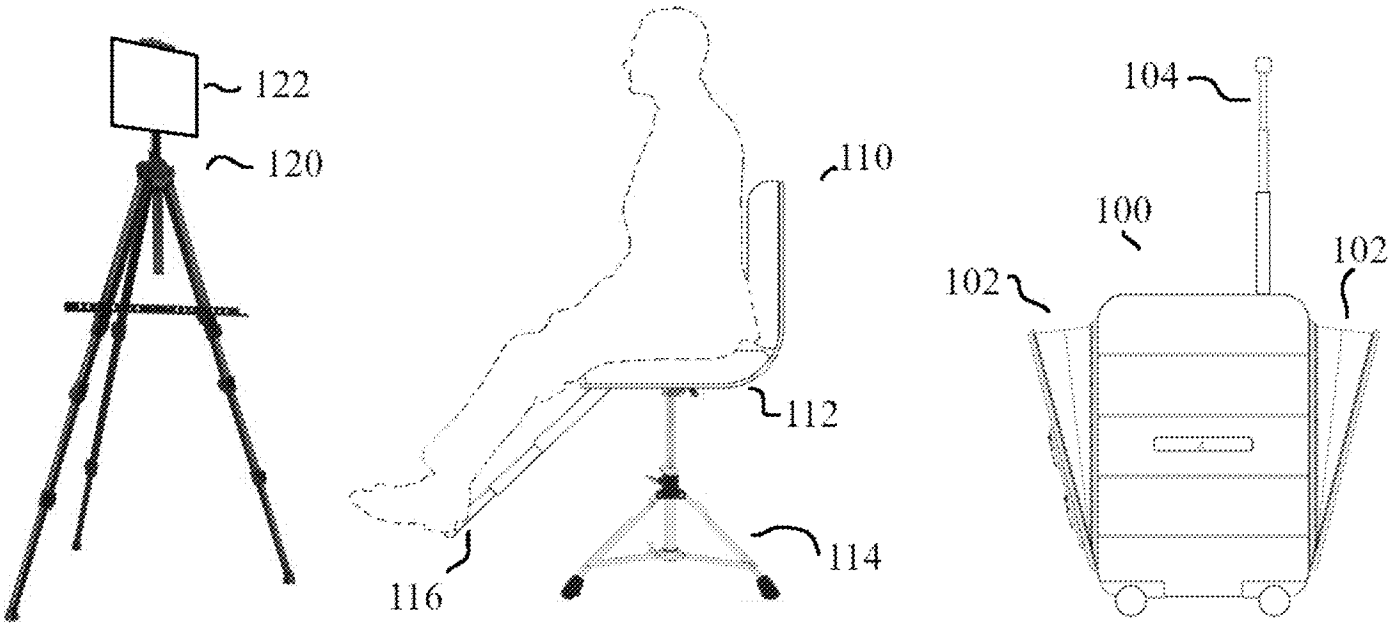
FIG. 1 shows a portable hairstylist's salon according to an embodiment of the present invention.

Referring now to the drawings in more detail, FIG. 1 shows a portable stylists salon 10 according to an embodiment of the present invention. The portable stylists' salon 10 includes a portable case 100, a salon chair 110, and an accessories stand 120. According to one embodiment, the portable case 100 includes case openings 102 for access to the inside of the portable case 100, an extendable handle 104 for pulling the portable case 100, as well as mounting additional accessories when in use.

The salon chair 110 further comprises a chair seat 112 and a chair base 114. In a further embodiment the salon chair 110 further includes a foot rest 116. When in use, the chair seat 112 interconnects with the chair base 114, wherein the chair base 114 is adjustable and may extend or retract allowing for a height adjustment that allows a client to be placed at a convenient height for access by the stylist. In further embodiments, the chair base 114 may be hydraulic, pneumatic, or other mechanism for ease of adjustment. In a further embodiment, the foot rest 116 connects with the chair seat 112. In a further embodiment, the foot rest 116 is extendable and collapsible for adjustment specific to a client.

When stored or transported, the collapsible stand 114 and foot rest 116 are detachable and collapsible for compact storage within the portable case 100. The chair seat 112 is formed in a manner that allows it to be placed on the portable case 100 and over the extendable handle 104 to secure the chair seat 112 to the portable case 100 when in transit.

The accessories stand 120 provides a collapsible stand that may be stored in a compact manner within the portable case 100 when not in use. When in use, accessories may be attached to the accessories stand 120, such as a mirror 122. In further embodiments, additional accessories, such as trays, shelves, tool holders, or other items may be attached to the accessories stand 120 when in use to provide convenient access for the hairstylist.

Figure 2A:
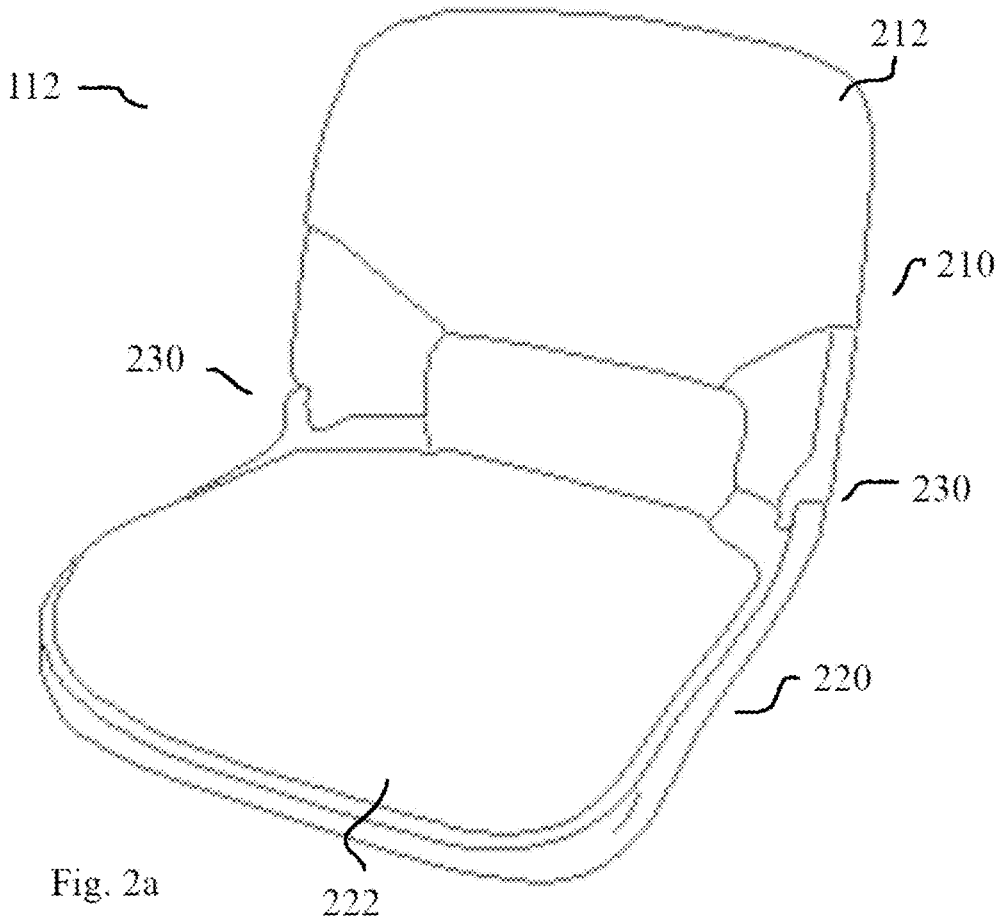
FIG. 2*a* shows a detailed view of chair base for use with the portable stylist's salon in accordance with an embodiment of the present invention.

FIG. 2*a* shows a detailed view of chair seat 112 for use with the portable stylists' salon in accordance with an embodiment of the present invention. As shown, the chair seat 112 further includes a back section 210 and a seat section 220. In a further embodiment, the back section 210 and the seat section 220 are interconnected with one or more hinges 230. According to one embodiment, the one or more hinges 230 allow the back section 210 to fold flat to the seat section 220 create a compact version of the chair seat 112. In a further embodiment, the back section 210 may be reclined when needed for shampooing or other activities.

Figure 2B:
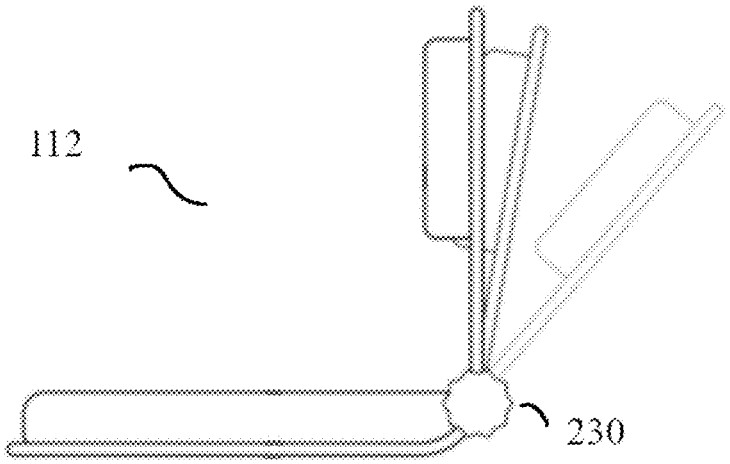
FIG. 2*b* shows a view of the chair base according to another embodiment of the present invention.

The one or more hinges 230 will also provide the ability to lay a client backward to allow for use of a sink basin, when available, to wash the client's hair or other uses. In accordance with further embodiments of the present invention, the back section 210 further includes a back pad 212 and seat section 220 further includes seat pad 222. FIG. 2*b* further shows a chair seat 112 with hinge 230 according to another embodiment of the present invention.

Figure 3A:
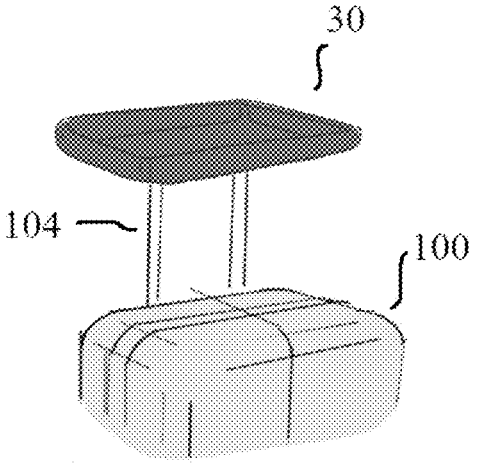
FIG. 3*a*, shows an accessory tray for use with the portable stylist's salon according to an embodiment of the present invention.
Figure 3B:
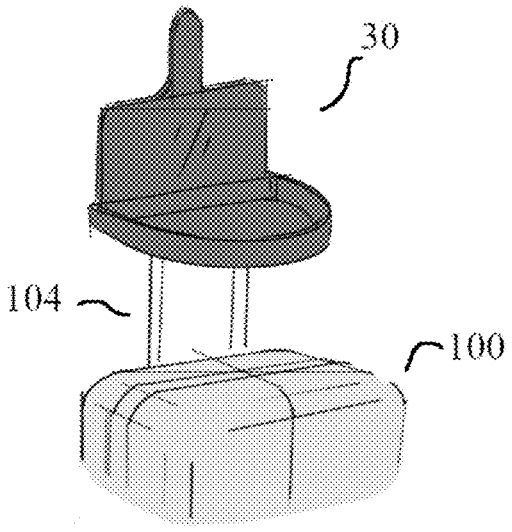
FIG. 3*b* shows an embodiment of an accessory tray with a pocket for placing over the extendable handle in accordance with an embodiment of the present invention.

Turning to FIG. 3*a*, an accessory tray 30 according to an embodiment of the present invention is shown. The accessory tray 30, as shown, attaches with a compression fit to the extendable handle 104 of the portable case 100. In a further embodiment, the accessory tray 30 is attached with hook and loop fasteners. Further embodiments of the accessory tray 30 allow for a connection with the extendable handle 104 on the vertical extension posts 104 of the extendable handle 104. FIG. 3*b* shows a further embodiment in which the accessory tray 30 has a pocket that is placed over the extendable handle 104 to securely fasten the tray to the portable case 100.

Figure 3C:
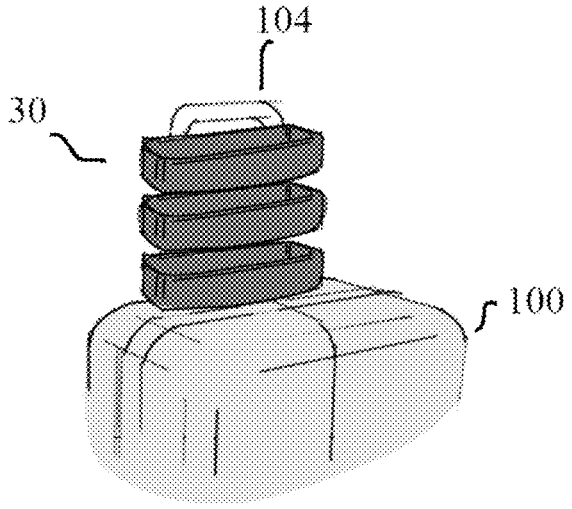
FIG. 3*c* shows multiple accessory trays in accordance with another embodiment of the present invention.
Figure 3D:
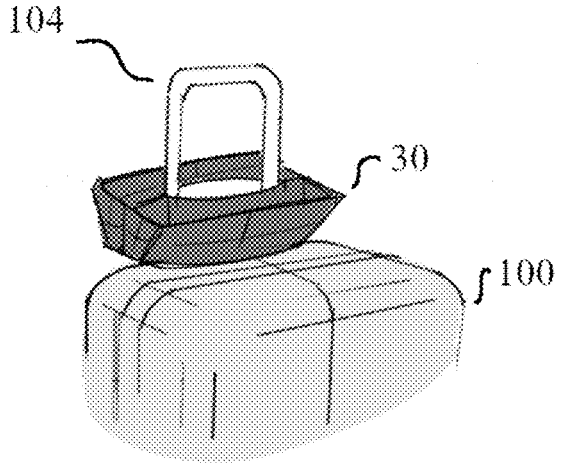
FIG. 3*d* shows an accessory tray in accordance with another embodiment of the present invention.
Figure 3E:
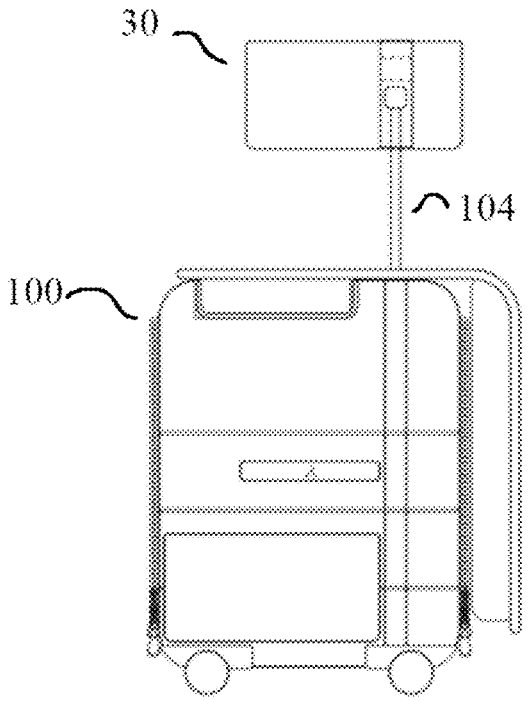
FIG. 3*e* show an accessory tray according to a further embodiment of the present invention.
Figure 7:
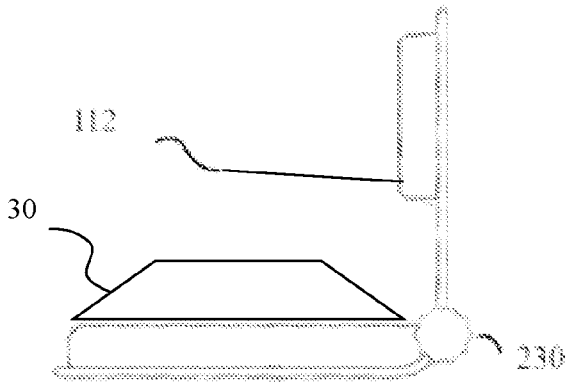
FIG. 7 shows a tray inverted for use as a booster seat.

FIG. 3*c* provides a view of multiple accessory trays 30 attached to the extendable handle 104 of the portable case 100, in accordance with another embodiment of the present invention. FIG. 3*d* provides a view of another embodiment of accessory tray 30 attached to the extendable handle 104 of the portable case 100, in accordance with a further embodiment of the present invention. FIG. 3*e* provides yet another embodiment of accessory tray 30. As shown in FIG. 3*e* accessory tray 30 contains a pocket that rests on the extendable handle 104. In a further embodiment, the tray 30 provides a service basket with an indent or groove to fit on the handle of the portable case. This particular tray is deeper than other trays to be able to hold color bowls and materials for color treatments. In a further embodiment, the deep tray 30 may also be inverted and used as a booster seat as seen in FIG. 7.

Figure 4:
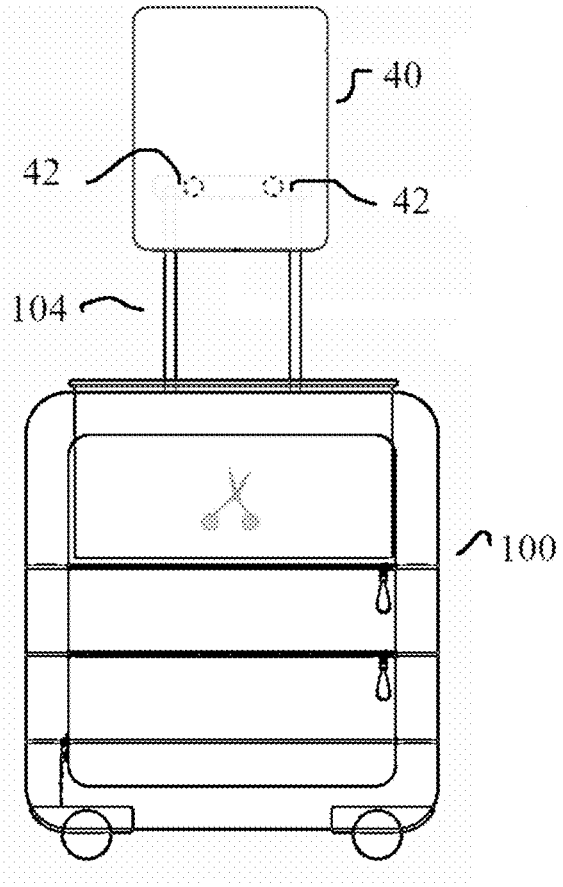
FIG. 4 shows a mirror attached to the extendable handle of the portable case in accordance with an embodiment of the present invention.

While many more embodiments could be shown, it will be apparent to one skilled in the art that many additional combinations of accessory trays may be configured to attach to the extendable handle 104, as well as the accessory stand 120 without deviating from the scope and intent of the present invention FIG. 4 shows a view of a mirror 40 attached to the extendable handle 104 of the portable case 100 in accordance with an embodiment of the present invention. Pursuant to FIG. 4, the mirror 40 is attached with magnets 42 to the extendable handle 104. In further embodiments, the mirror 40 may be attached with hook and loop fasteners, compression fittings, a pocket for placing over the extendable handle 104. Returning to FIG. 1, accessory stand 120 may also hold a mirror 122 allowing for a client to see mirror 40; thus, being able to view the back of their head while their hair is being cut or styled.

Figure 5:
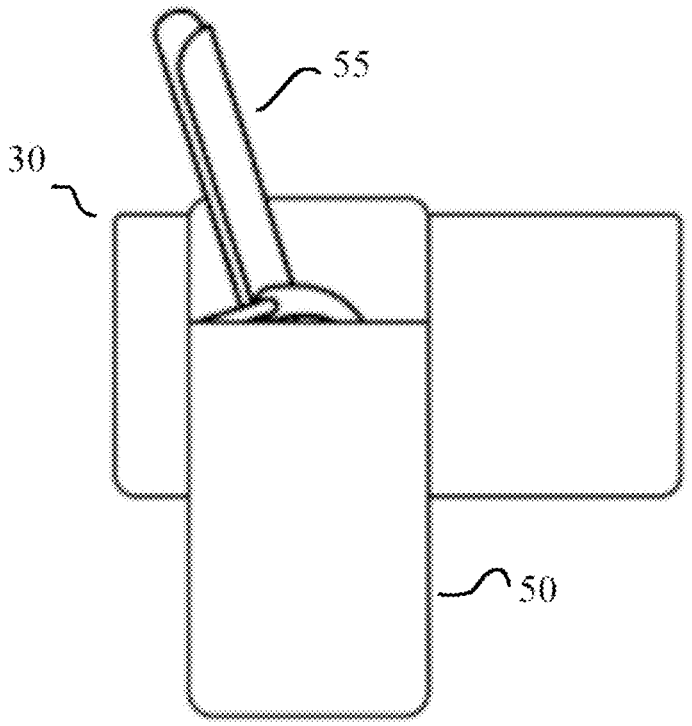
FIG. 5 shows a front view of a silicone pocket for use with the with the stylist's salon, according to an embodiment of the present invention.
Figure 8:
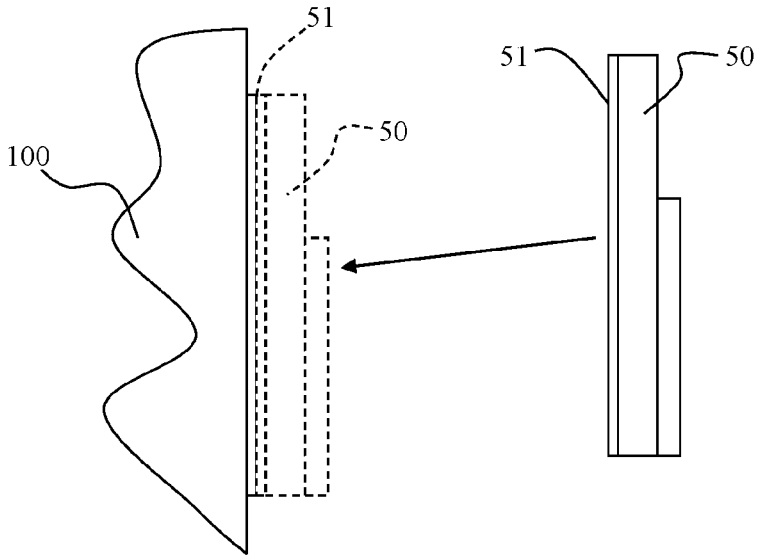
FIG. 8 shows a heat resistant pocket that is attachable to and detachable from a case.

FIG. 5 shows a front view of a heat resistant pocket 50 for use with the stylist's salon 10. According to various embodiments of the present invention, heat resistant pocket 50 may be attached to the portable case 100 for holding tools 55 such as flat irons and curling irons that may damage other materials due to excessive heat. The heat resistant pocket 50 insulates surrounding materials from the heat of the tool 55. In one embodiment, the heat resistant pocket is made of silicone. In a further embodiment shown in FIG. 8, the heat resistant pocket is incorporated as a pocket in the portable case 100. According to various embodiments, the heat resistant pocket 50 may be removably attached to the portable case 100 with hook-and-loop fasteners 51, magnets, or other connectors.

Figure 6A:
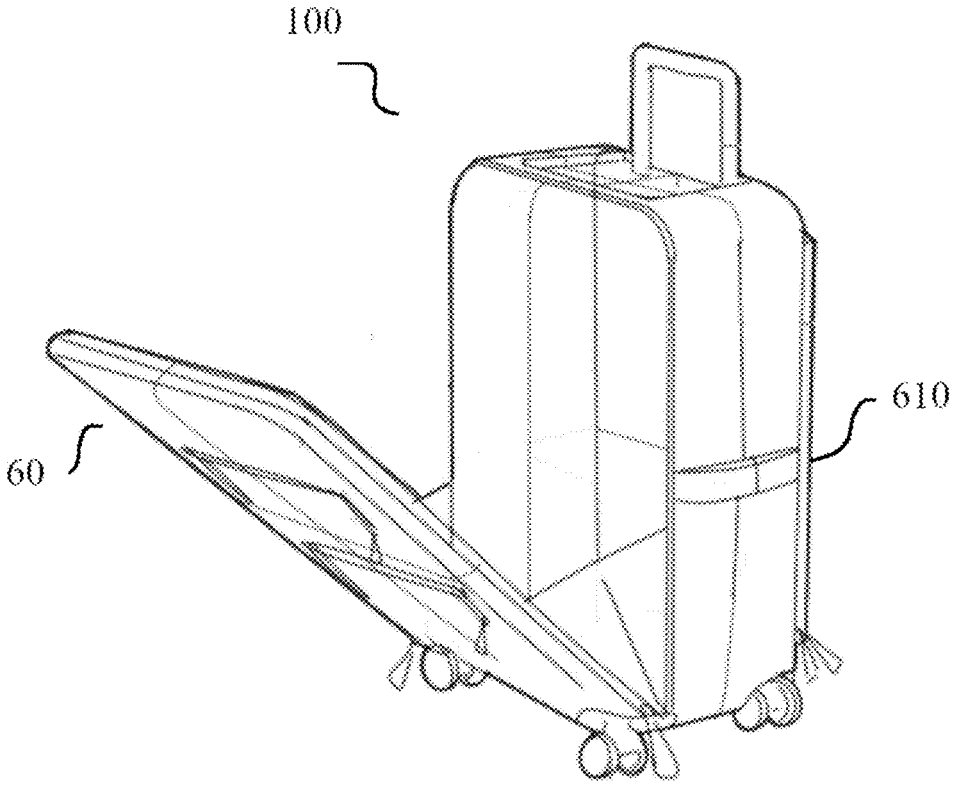
FIG. 6*a* shows a portable case according to a further embodiment of the present invention.

FIG. 6*a* shows a further embodiment of portable case 100 of the stylist's salon 10. According to the embodiment shown in FIG. 6*a*, the portable case 100 further comprises a front panel 60 that folds open to allow access to the internal compartments of the portable case 100. The portable case 100 further includes vertically-oriented handle 610 on the side of portable case 100. Further embodiments of the portable case 600 may include side panels, pockets, or various combinations of panels and pockets. According to various embodiments, the portable case 100 includes openings to hold the chair base 114, the foot rest 116, the mirror easel 120, as well as provide a location for refuse and used items, such as drop clothes.

Figure 6B:
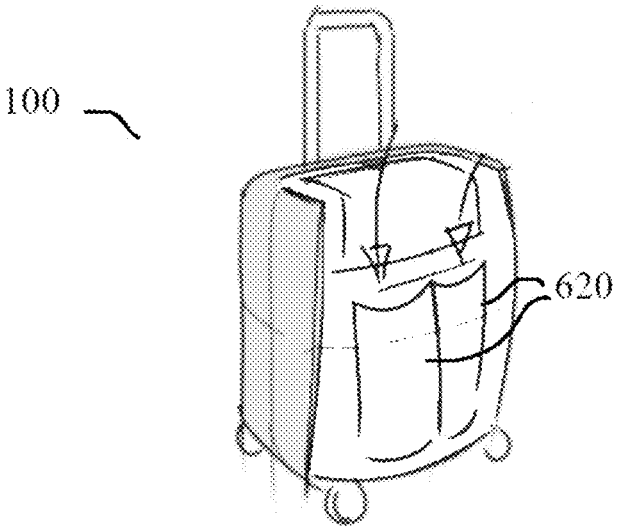
FIG. 6*b* shows a portable case in accordance with a further embodiment of the present invention.
Figure 6C:
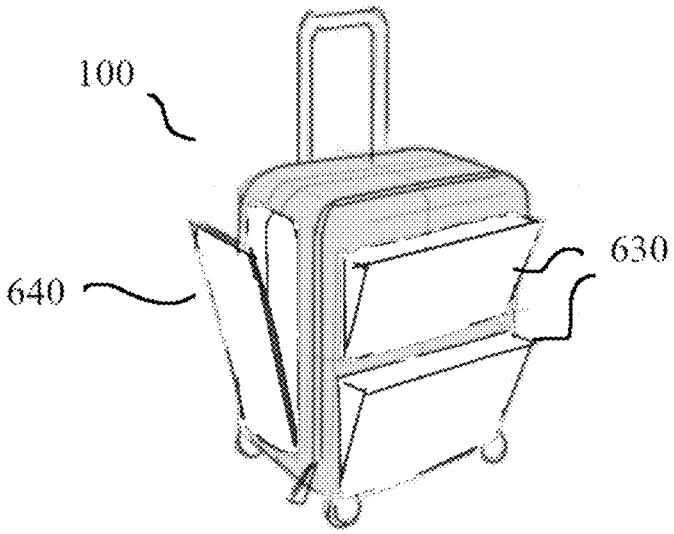
FIG. 6*c* shows a portable case according to a further embodiment of the present invention.

FIG. 6*b* shows a further embodiment of the portable case 100 with pockets 620 to hold stylist's tools or other items from the portable salon 10. FIG. 6*c* shows a further embodiment of the portable case 100 with multiple access doors 630 on the front of the portable case 100, as well as a side opening 640 for access to the portable case 100 from the side without needing to empty the contents of the portable case 100 to access items near the bottom.

While many more embodiments could be shown, it will be apparent to one skilled in the art that many additional configurations could be disclosed without deviating from the scope and intent of the present invention.

In summary, the stylist's salon and improved accessories disclosed above provide examples that are illustrative of some of the applications of the principles of the present subject matter. Thus it is contemplated that the stylist's salon and accessories may be constructed for many different applications and alterations may be made wherein a stylist's salon may include many of the above-mentioned advantages. Further additions or alterations may be made and may be made without departing from the spirit and scope of the present disclosure. Furthermore, those skilled in the art will understand that a number of variations, including those described, may be made to the fabrics, materials, and other elements, and the processes for making parts of the stylist's salon, all without departing from the scope of the invention, which is described above and defined by the appended claims.

What is claimed is:

1. A portable stylist's salon comprising:

a case with one or more openings at a top of the case for loading and accessing the contents of the case;

an extendable handle attached to the case and extendable from and at least partially retractable into the case; and an adjustable chair comprising a chair seat with a chair base, the chair base being removably attachable to the chair seat and being adjustable in length to set the chair seat at different heights, wherein the chair base is collapsible and, when collapsed, is adapted to be disposed in the case, and one or more accessory devices, the one or more accessory devices having an opening for receiving a portion of the extendable handle, wherein an accessory device of the one or more accessory devices 1s adapted to be inverted and positioned on the chair seat to function as a booster seat.

2. The portable stylist's salon of claim 1, wherein a top end of the extendable handle is received in the opening in a second one of the one or more accessory devices and the second one of the one or more accessory devices defines a surface at a top of the extendable handle.

3. The portable stylist's salon of claim 2, wherein the second one of the one or more accessory devices comprises a pocket for receiving a top end of the extendable handle.

4. The portable stylist's salon of claim 1, wherein the extendable handle extends entirely through the opening in the accessory device.

5. The portable stylist's salon of claim 1, further comprising a collapsible accessory stand, the accessory stand being adapted to be disposed in the case when collapsed, one or more accessory stand accessory devices being attachable to and detachable from the accessory stand.

6. The portable stylist's salon of claim 1, comprising a plurality of accessory devices of the one or more accessory devices attachable to different positions on the extendable handle.

7. The portable stylist's salon of claim 6, wherein at least one of the plurality of accessory devices is attachable to the extendable handle by a different form of connection than at least one other one of the plurality of accessory devices.

8. A portable stylist's salon, comprising:

a case with wheels and an extendable handle; and an adjustable chair comprising a chair seat, a chair base removably attachable to the chair seat, and a chair foot rest removably attached to the chair seat, wherein the chair base and the chair foot rest are collapsible and, when collapsed, are adapted to be disposed in the case, and a heat resistant pocket, one or more accessory devices, the one or more accessory devices having an opening for receiving a portion of the extendable handle, wherein an accessory device of the one or more accessory devices is adapted to be inverted and positioned on the chair seat to function as a booster seat.

9. The portable stylist's salon of claim 8, wherein the heat resistant pocket is built into the case.

10. The portable stylist's salon of claim 8, wherein the heat resistant pocket is attachable to and detachable from the case.

11. A portable stylist's salon comprising:

a case with one or more openings at a top of the case for loading and accessing the contents of the case;

an extendable handle attached to the case and extendable from and at least partially retractable into the case; and an adjustable chair comprising a chair seat with a chair base, the chair base being removably attachable to the chair seat and being adjustable in length to set the chair seat at different heights, wherein the chair base is collapsible and, when collapsed, is adapted to be disposed in the case, and wherein the case comprises at least one panel on at least one side of the case, the at least one panel being pivotably attached to the at least one side of the case, one or more accessory devices, the one or more accessory devices having an opening for receiving a portion of the extendable handle, wherein an accessory device of the one or more accessory devices is adapted to be inverted and positioned on the chair seat to function as a booster seat.

12. A portable stylist's salon, comprising:

a case with wheels and an extendable handle; and an adjustable chair comprising a chair seat, a chair base removably attachable to the chair seat, and a chair foot rest removably attached to the chair seat, wherein the chair base and the chair foot rest are collapsible and, when collapsed, are adapted to be disposed in the case, and one or more accessory devices, the one or more accessory devices having an opening for receiving a portion of the extendable handle, wherein an accessory device of the one or more accessory devices is adapted to be inverted and positioned on the chair seat to function as a booster seat.

13. The portable stylist's salon of claim 12, further comprising a collapsible accessory stand, the accessory stand being adapted to be disposed in the case when collapsed, one or more accessory stand accessory devices being attachable to and detachable from the accessory stand.

14. The portable stylist's salon of claim 12, wherein the one or more accessory devices comprises comprising a plurality of accessory devices, attachable to different positions on the extendable handle, wherein at least one of the plurality of accessory devices is attachable to the extendable handle by a different form of connection than at least one other one of the plurality of accessory devices.

* * * * *